US007207303B2

(12) United States Patent
Geyer et al.

(10) Patent No.: US 7,207,303 B2
(45) Date of Patent: Apr. 24, 2007

(54) SWITCHING ELEMENT

(75) Inventors: Norbert Geyer, Hochstadt (DE); Peter Sailer, Erlangen (DE); Oliver Schnell, Veitsbronn (DE)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/402,904

(22) Filed: Apr. 13, 2006

(65) Prior Publication Data

US 2006/0219199 A1 Oct. 5, 2006

Related U.S. Application Data

(62) Division of application No. 10/498,481, filed as application No. PCT/EP03/00307 on Jan. 15, 2003.

(60) Provisional application No. 60/354,628, filed on Feb. 6, 2002.

(30) Foreign Application Priority Data

Feb. 6, 2002 (DE) ..... 102 04 672

(51) Int. Cl.
*F01L 1/14* (2006.01)

(52) U.S. Cl. ..... 123/90.55; 123/90.48; 123/90.5; 123/90.52

(58) Field of Classification Search ..... 123/90.55
See application file for complete search history.

(56) References Cited

U.S. PATENT DOCUMENTS 3,108,580 A 10/1963 Crane ..... 123/90

(Continued)

FOREIGN PATENT DOCUMENTS

DE 42 06 166 A1 9/1992
DE 43 32 660 A1 3/1995
DE 43 33 927 A1 4/1995

(Continued)

OTHER PUBLICATIONS

Quan Zheng, "Characterization of the Dynamic Response of a Cylinder Deactivation Valvetrain System," Society of Automotive Engineers, Inc., SAE Technical Paper Series, Mar. 2001, pp. 195-201.

(Continued)

*Primary Examiner*—Thomas Denion
*Assistant Examiner*—Kyle M. Riddle
(74) *Attorney, Agent, or Firm*—Fitzpatrick, Cella, Harper & Scinto

(57) ABSTRACT

A switch element (1) is proposed for valve shut-off, fabricated as cam follower for a plunger rod valve drive of an internal combustion engine, having an outer part (2) and an inner element (4) axially movable in its bore (3) and with rotational security (15) relative to the guided inner element (4). The outer part (2), inside the bore (3), has an annular groove (6), and the inner element (4) has a radial bore (7) with two diametrically opposed pistons (8), which to couple the elements (2, 4) in their axially remote relative position achieved by a lost-motion spring (5) are displaceable towards the annular groove (6). On their cam-side under side, emanating from their radially outward, bulbous face, the pistons (8) segmentwise comprise a plane transverse surface as contact area for a facing under side (27) of the annular groove (6). The latter is intersected by two diametrically opposed oil ports (11) running offset 90° from the pistons (8) in circumferential direction. In addition, the outer part (2) has means (13) for rotationally secured guidance of the switch element (1) relative to a surrounding structure.

26 Claims, 1 Drawing Sheet

U.S. PATENT DOCUMENTS

| | | | | |
|---|---|---|---|---|
| 3,886,808 | A | 6/1975 | Weber | 74/569 |
| 4,054,109 | A | 10/1977 | Herrin et al. | 123/90.16 |
| 4,083,334 | A | 4/1978 | Roncon | 123/90.35 |
| 4,089,234 | A | 5/1978 | Henson et al. | 74/569 |
| 4,098,240 | A | 7/1978 | Abell, Jr. | 123/90.55 |
| 4,133,332 | A | 1/1979 | Benson et al. | 123/198 F |
| 4,164,917 | A | 8/1979 | Glasson | 123/321 |
| 4,207,775 | A | 6/1980 | Lintott | 74/55 |
| 4,228,771 | A | 10/1980 | Krieg | 123/90.55 |
| 4,231,267 | A | 11/1980 | Van Slooten | 74/569 |
| 4,386,806 | A | 6/1983 | Axen et al. | 299/5 |
| 4,463,714 | A | 8/1984 | Nakamura | 123/90.57 |
| 4,546,734 | A | 10/1985 | Kodama | 123/90.16 |
| 4,576,128 | A | 3/1986 | Kenichi | 123/198 |
| 4,615,307 | A | 10/1986 | Kodama et al. | 123/90.16 |
| 4,739,675 | A | 4/1988 | Connell | 74/569 |
| 4,768,475 | A | 9/1988 | Ikemura | 123/90.16 |
| 4,790,274 | A | 12/1988 | Inoue et al. | 123/198 F |
| 4,905,639 | A | 3/1990 | Konno | 123/90.16 |
| 4,913,106 | A | 4/1990 | Rhoads | 123/90.49 |
| 4,941,438 | A | 7/1990 | Muto | 123/90.46 |
| 4,942,855 | A | 7/1990 | Muto | 123/90.33 |
| 5,085,182 | A | 2/1992 | Nakamura et al. | 123/90.16 |
| 5,088,455 | A | 2/1992 | Moretz | 123/90.5 |
| 5,090,364 | A | 2/1992 | McCarroll et al. | 123/90.16 |
| 5,099,806 | A | 3/1992 | Murata et al. | 123/90.16 |
| 5,245,958 | A | 9/1993 | Krieg et al. | 123/90.55 |
| 5,247,913 | A | 9/1993 | Manolis | 123/90.16 |
| 5,253,621 | A | 10/1993 | Dopson et al. | 123/90.16 |
| 5,255,639 | A | 10/1993 | Shirey et al. | 123/90.16 |
| 5,261,361 | A | 11/1993 | Speil | 123/90.22 |
| 5,307,769 | A | 5/1994 | Meagher et al. | 123/90.5 |
| 5,345,904 | A | 9/1994 | Dopson et al. | 123/198 F |
| 5,351,662 | A | 10/1994 | Dopson et al. | 123/90.16 |
| 5,357,916 | A | 10/1994 | Matterazzo | 123/90.16 |
| 5,361,733 | A | 11/1994 | Spath et al. | 123/90.16 |
| 5,398,648 | A | 3/1995 | Spath et al. | 123/90.16 |
| 5,402,756 | A | 4/1995 | Bohme et al. | 123/90.16 |
| 5,419,290 | A | 5/1995 | Hurr et al. | 123/90.16 |
| 5,429,079 | A | 7/1995 | Murata et al. | 123/90.16 |
| 5,431,133 | A | 7/1995 | Spath et al. | 123/90.16 |
| 5,501,186 | A | 3/1996 | Hara et al. | 123/90.16 |
| 5,544,626 | A | 8/1996 | Diggs et al. | 123/90.16 |
| 5,544,628 | A | 8/1996 | Voigt | 123/90.16 |
| 5,546,899 | A | 8/1996 | Sperling et al. | 123/90.5 |
| 5,555,861 | A | 9/1996 | Mayr et al. | 123/90.16 |
| 5,615,651 | A | 4/1997 | Miyachi | 123/198 F |
| 5,651,335 | A | 7/1997 | Elendt et al. | 123/90.16 |
| 5,655,487 | A | 8/1997 | Maas et al. | 123/90.16 |
| 5,660,153 | A | 8/1997 | Hampton et al. | 123/90.16 |
| 5,669,342 | A | 9/1997 | Speil | 123/90.16 |
| 5,682,848 | A | 11/1997 | Hampton et al. | 123/90.16 |
| 5,709,180 | A | 1/1998 | Spath | 123/90.16 |
| 5,720,244 | A | 2/1998 | Faria | 123/90.16 |
| 5,782,216 | A | 7/1998 | Haas et al. | 123/90.16 |
| 5,803,040 | A | 9/1998 | Biesinger et al. | 123/198 F |
| 5,832,884 | A | 11/1998 | Haas et al. | 123/90.16 |
| 5,875,748 | A | 3/1999 | Haas et al. | 123/90.16 |
| 5,893,344 | A | 4/1999 | Church | 123/90.16 |
| 5,934,232 | A | 8/1999 | Greene et al. | 123/90.16 |
| 6,032,643 | A | 3/2000 | Hosaka et al. | 123/321 |
| 6,039,017 | A | 3/2000 | Hendriksma | 123/90.43 |
| 6,053,133 | A | 4/2000 | Faria et al. | 123/90.16 |
| 6,076,491 | A | 6/2000 | Allen | 123/90.16 |
| 6,092,497 | A | 7/2000 | Preston et al. | 123/90.16 |
| 6,095,696 | A | 8/2000 | Foldi | 385/79 |
| 6,164,255 | A | 12/2000 | Maas et al. | 123/90.16 |
| 6,196,175 | B1 | 3/2001 | Church | 123/90.16 |
| 6,196,176 | B1 * | 3/2001 | Groh et al. | 123/90.16 |
| 6,213,076 | B1 | 4/2001 | Fischer et al. | 123/90.55 |
| 6,244,229 | B1 | 6/2001 | Nakano et al. | 123/90.15 |
| 6,247,433 | B1 | 6/2001 | Faria et al. | 123/90.16 |
| 6,257,185 | B1 | 7/2001 | Groh et al. | 123/90.16 |
| 6,273,039 | B1 | 8/2001 | Church | 123/90.16 |
| 6,318,324 | B1 | 11/2001 | Koeroghlian et al. | 123/90.55 |
| 6,321,704 | B1 | 11/2001 | Church et al. | 123/90.16 |
| 6,321,705 | B1 | 11/2001 | Fernandez et al. | 123/90.16 |
| 6,325,030 | B1 | 12/2001 | Spath et al. | 123/90.16 |
| 6,345,596 | B1 | 2/2002 | Kuhl | 123/90.16 |
| 6,405,699 | B1 | 6/2002 | Church | 123/90.5 |
| 6,412,460 | B1 | 7/2002 | Sato et al. | 13/90.16 |
| 6,427,652 | B2 | 8/2002 | Faria et al. | 123/90.16 |
| 6,439,176 | B1 | 8/2002 | Payne et al. | 123/90.12 |
| 6,460,499 | B1 | 10/2002 | Mason et al. | 123/90.55 |
| 6,477,997 | B1 | 11/2002 | Wakeman | 123/90.16 |
| 6,497,207 | B2 | 12/2002 | Spath et al. | 123/90.16 |
| 6,513,470 | B1 | 2/2003 | Hendriksma et al. | 123/90.16 |
| 6,578,535 | B2 | 6/2003 | Spath et al. | 123/90.16 |
| 6,588,394 | B2 | 7/2003 | Zheng | 123/198 F |
| 6,591,796 | B1 | 7/2003 | Scott | 123/90.13 |
| 6,595,174 | B2 | 7/2003 | Schnell | 123/90.55 |
| 6,606,972 | B2 | 8/2003 | Wenisch et al. | 123/90.17 |
| 6,615,783 | B2 | 9/2003 | Haas et al. | 123/90.48 |
| 6,655,487 | B2 | 12/2003 | Mallette et al. | 180/190 |
| 6,668,776 | B2 | 12/2003 | Hendriksma et al. | 123/90.16 |
| 6,745,737 | B2 | 6/2004 | Evans et al. | 123/90.5 |
| 6,748,914 | B2 | 6/2004 | Spath et al. | 123/90.48 |
| 6,802,288 | B2 | 10/2004 | Spath | 123/90.16 |
| 6,814,040 | B2 | 11/2004 | Hendriksma et al. | 123/90.59 |
| 6,866,014 | B2 | 3/2005 | Spath | 123/90.5 |
| 6,920,857 | B2 | 7/2005 | Spath | 123/90.48 |
| 6,976,463 | B2 | 12/2005 | Spath et al. | 123/90.59 |
| 6,997,154 | B2 | 2/2006 | Geyer et al. | 123/90.44 |
| 7,007,651 | B2 | 3/2006 | Spath | 123/90.5 |
| 2001/0009145 | A1 | 7/2001 | Faria et al. | 123/90.16 |
| 2002/0038642 | A1 | 4/2002 | Haas et al. | 123/90.48 |
| 2002/0195072 | A1 | 12/2002 | Spath et al. | 123/90.16 |
| 2003/0070636 | A1 | 4/2003 | Evans et al. | 123/90.5 |
| 2003/0075129 | A1 | 4/2003 | Spath et al. | 123/90.16 |
| 2003/0101953 | A1 | 6/2003 | Hendriksma et al. | 123/90.16 |
| 2005/0081811 | A1 | 4/2005 | Spath et al. | 123/90.48 |
| 2005/0103300 | A1 | 5/2005 | Spath et al. | 123/90.59 |
| 2006/0191503 | A1 | 8/2006 | Geyer et al. | 123/90.15 |

FOREIGN PATENT DOCUMENTS

| | | | |
|---|---|---|---|
| DE | 198 04 952 | A1 | 8/1999 |
| DE | 199 15 531 | A1 | 10/2000 |
| DE | 199 15 532 | A1 | 10/2000 |
| DE | 199 19 245 | A1 | 11/2000 |
| EP | 0 318 151 | A1 | 5/1989 |
| EP | 0 608 925 | B1 | 8/1994 |
| EP | 1 149 989 | A1 | 10/2001 |
| GB | 574 852 | A | 1/1946 |
| GB | 2 272 022 | | 5/1994 |
| WO | WO 9530081 | A1 | 11/1995 |

OTHER PUBLICATIONS

K. Hampton, Eaton VRRS System, Society of Automotive Engineers, Inc., Variable Value Actuation TOPTEC®: The State of the Art, Sep. 11-12, 2000, 25 pages.

Buuk, B. et al., "Engine Trends and Valve Train Systems for Improved Performance and Fuel Economy", Eaton Corporation—Engine Components Operations, USA, pp. 1-9 (Aug. 1999).

Fortnagel, M. et al., "Four Made of Eight—The New 4.31 and 5.01 V8 Engines", Mercedes-Benz S-Class, pp. 58-62 (1997).

Sandford, M. et al., "Reduced Fuel Consumption and Emissions Through Cylinder Deactivation", Aachener Kolloquium Fahrzeug- und Motorentechnik, pp. 1017-1027 (1998).

Chrysler Group, "Design Practice Standards", Paper dated Mar. 15, 2005, 1 page, in German with English Translation (2 pages).

* cited by examiner

SWITCHING ELEMENT

CROSS REFERENCE TO RELATED APPLICATIONS

This application is a divisional of U.S. application Ser. No. 10/498,481, Jan. 27, 2005 the priority of which is hereby claimed under 35 U.S.C. § 120. U.S. application Ser. No. 10/498,481 is a National Stage filing under 35 U.S.C. § 371 of International Application No. PCT/EP03/00307, filed Jan. 15, 2003. International Application No. PCT/EP03/00307 claims priority of both German Application No. DE 102 04 672.7, filed Feb. 6, 2002, and U.S. Provisional Patent Application No. 60/354,628, filed Feb. 6, 2002, the priorities of each of which are hereby claimed, said International Application having been published in German, but not in English, as International Publication No. WO 03/067038 A1. U.S. application Ser. No. 10/498,481 is hereby incorporated by reference in its entirety, as if fully set forth herein.

BACKGROUND OF THE INVENTION

1. Field of the Invention

The invention relates to a switch element for valve shut-off, fabricated as a cam follower for a plunger rod valve drive of an internal combustion engine.

2. Description of the Related Art

Such a switch element has been disclosed in DE 199 15 531 A1. A disadvantage of this is that only a one-sided coupling is provided over a piston. Therefore, there is an unnecessarily high component load to be reckoned with in the coupling area. Besides, coupling involves an undesirable tilting of the inner element relative to the outer part. At the same time, it is found that the twist safety inserted in the radial bore of the inner element is relatively costly, particularly as its pressing in leads to undesirable deformation of the radial bore, which may adversely affect a proper lengthwise motion of the piston. Since the piston with its cylindrical jacket enters a bore in the outer part for coupling, the latter undesirably has only a very small bearing area, and in this case it is necessary to work with a very fine tolerance. When the piston is not properly run out, it may also happen, owing to the geometry in the transition to the bore, that only two edges bear. Here wear must be reckoned with. Last but not least, the switch element, because of its one-sided oil supply, must be built into its guide directionally.

SUMMARY OF THE INVENTION

The object of the invention, then, is to create a switch element of the kind above mentioned, in which the cited disadvantages are eliminated by simple means.

The switch element proposed eliminates the disadvantages described above.

Two pistons are provided as coupling means, running in the receptacle, configured as a radial bore, of the inner element, and there diametrically opposed to each other. As a result, we have an especially tilt-proof mechanism, generating only a small component load when coupled. Instead of the radial bore in the inner element, a blind hole or similar conformation is also conceivable. Besides, it is a subject matter of claim 1 for the receptacle of the outer part to be advantageously fabricated as an annular groove in its bore.

Further, the inner element is to be secured against rotation relative to the outer part, for example by means of a pin-like element. Thus the coupling means as regards their receptacle are positioned alike over the entire operating period of the switch element.

Likewise, it is proposed that the annular groove be intersected by two diametrically opposed oil ports, such as bores, offset 90° in circumferential direction from the piston. If two leads, opposed to each other, are provided in an oil gallery of a surrounding structure such as for example a cylinder head or guide for the switch element, connected to the internal combustion engine, then it does not matter which oil port of the switch element communicates with which lead. Preferably, the oil paths have equal lengths to achieve equal switch times. In the case of only one lead, of course, a directional installation of the switch element is necessary. Here, suitable markings can be placed on the latter to facilitate assembly.

As suitable means of rotationally securing the switch element relative to the surrounding structure, in a further aspect of the invention, flattenings are proposed on the outer jacket of the outer part.

Also, it is advantageous to provide a roller as cam counterpart.

Instead of the pistons as coupling means, other elements such as latches, balls, wedges and the like geometrical locking elements may be employed. If desired, a dynamic closure is conceivable as well.

BRIEF DESCRIPTION OF DRAWINGS

The invention is illustrated in more detail with reference to the drawings, in which.

DETAILED DESCRIPTION OF THE PREFERRED EMBODIMENT

Figure 1:
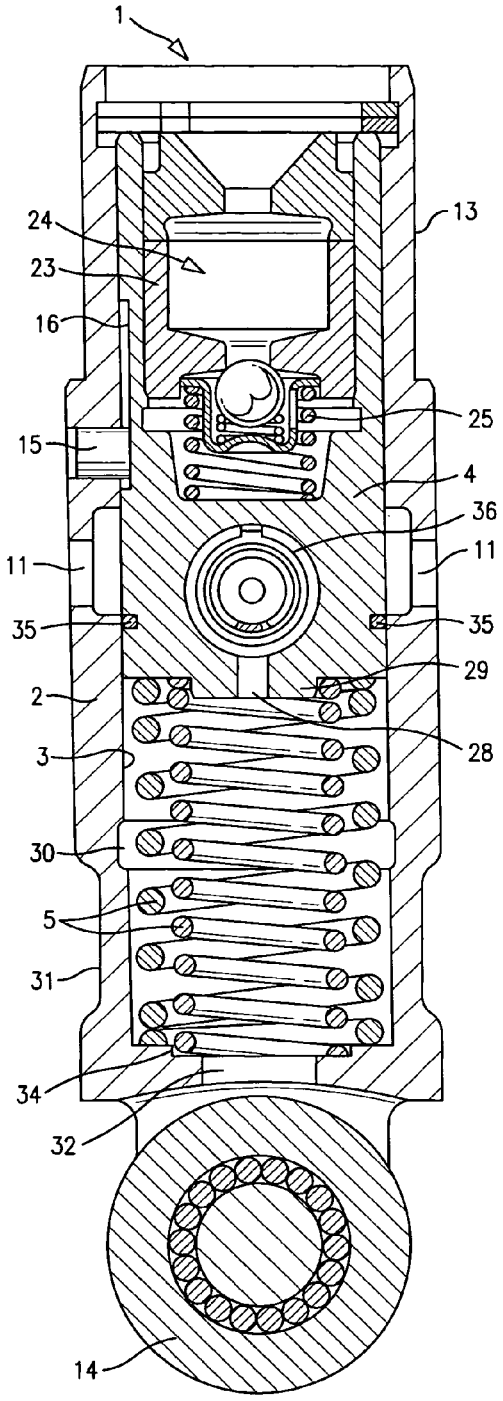
FIG. 1 shows a lengthwise section through a switch element configured as a roller plunger for a plunger rod drive.
Figure 2:
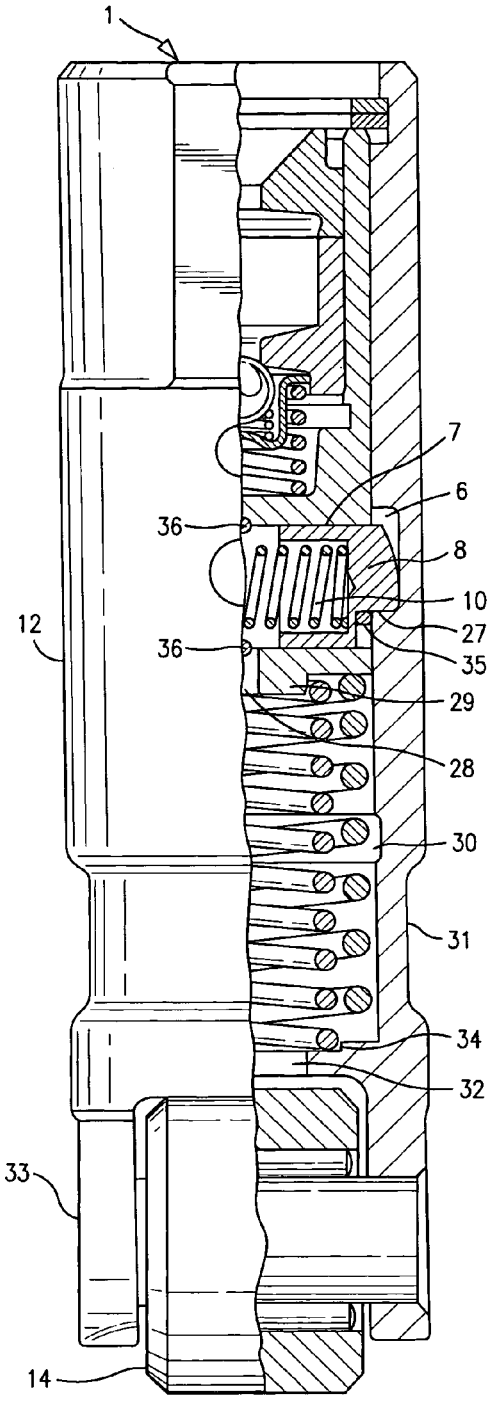
FIG. 2 represents a partial longitudinal section, rotated through 90°, of FIG. 1.

FIGS. 1 and 2 disclose a switch 1 for a valve drive of an internal combustion engine. This is here configured as a roller plunger for a plunger rod drive. It consists of an outer part 2, in whose bore 3 an axially movable inner element 4 runs. The inner element 4 and the outer part 2 are urged away from each other by a "lost-motion spring" 5, not to be described in detail, although in the illustrated embodiment, component 5 comprises two springs. The inner element 4 is adapted to receive therein a hydraulic clearance equalization element (lash adjuster 24) having a pressure system (23).

In the axial position of the outer part 2, graphically shown distant from the inner element 4, their receptacles 6, 7 are in line. The receptacle 6 of the outer part 2 is fabricated as an encircling annular groove. The receptacle 7 on the inner element 4, by contrast, is configured as a through bore extending radially. In this, two diametrically opposed coupling means 8 are arranged, here configured as pistons. A radially outer face of the coupling means 8 is shown bulbous, having on its under side segmentally a plane transverse surface as contact area for a facing under side 27 of the annular groove 6 (see FIG. 2). Thus, as can be seen in FIG. 2, each of the coupling means (also referred to herein as "couplers") 8 has a stepped flat for engagement with the facing under side 27 of the annular groove 6.

The couplers 8 are acted upon radially outward by the force of a compression spring means 10 (coupling direction). Radially inward, i.e. in uncoupling direction, the couplers 8 can be displaced by hydraulic means. For this purpose, the outer part 2 may suitably have two diametrically opposed oil ports 11 (see FIG. 1). These are configured as a bore and offset 90° in circumferential direction from the couplers 8. An anti-rotation component 35, such as a ring, is arranged to substantially prevent rotation of the couplers 8 about their respective axes, and a stop member 36, such as another ring, is arranged to limit the distance by which the couplers 8 can be displaced towards each other.

Further, one skilled in the art will see from the figures that on the outer jacket 12 of the outer part 2, means 13 of security against rotation are applied. These are configured as mutually opposed flattenings. This measure is necessary firstly to connect the oil ports 11 with their supply lines, and secondly to orient a roller 14 with a cam, not shown.

According to another aspect of the invention, a further port 28 is formed in a lower portion of the inner element 4, and is in communication with the radial bore 7. Also, the inner element 4 includes a lower end defining a raised pad 29.

The outer part 2 also has a further annular groove 30 facing the bore 3. The groove 30 is disposed below the inner element 4, at least when the couplers 8 couple the inner element 4 to the outer part 2. Also, part of an outer surface of the part 2, disposed proximate to a lower end of the outer part 2, forms an annular recess 31, and a lower surface of the outer part has a further bore 32 formed therethrough. The further bore 32 is in communication with the bore 3 of the outer part 2. Futhermore, a recess 34 is formed in a lower surface of the outer part 2 facing the bore 3, and the recess 34 forms a seat for receiving a lower end of at least part of the lost-motion spring 5. The outer part 2 also includes at its lower end a U-shaped configuration 33 for engaging roller 14, which is adapted to engage the cam (not shown).

| | |
|---|---|
| 1 | switch element |
| 2 | outer part |
| 3 | bore |
| 4 | inner element |
| 5 | "lost motion" spring |
| 6 | annular groove |
| 7 | radial bore |
| 8 | piston |
| 9 | unassigned |
| 10 | compression spring means |
| 11 | oil port |
| 12 | outer jacket |
| 13 | means |
| 14 | roller |
| 15 | anti-rotation safety element |
| 16 | lengthwise recess |
| 17 | annular groove |
| 23 | pressure piston |
| 24 | clearance compensator |
| 25 | compression spring |
| 27 | under side |
| 28 | port |
| 29 | raised pad |
| 30 | annular groove |
| 31 | annular recess |
| 32 | bore |
| 33 | U-shaped configuration |
| 34 | recess |
| 35 | anti-rotation component |
| 36 | stop member |

What is claimed is:

1. A switch element for valve shut-off, fabricated as a cam follower for a plunger rod valve drive of an internal combustion engine, the switch element comprising an outer part and an inner element axially movable in the bore thereof and guided vis-à-vis the outer part by way of an anti-rotation safety element, the outer part having an annular groove inside the bore and the inner element having a radial bore with two diametrally opposed pistons that are displaceable into the annular groove, to couple the outer part and inner element in their relative positions achieved via a lost-motion spring, wherein the pistons have a planar surface as a contact area to face an under side of the annular groove, the annular groove is intersected by at least one oil port offset in a circumferential direction from the pistons, the outer part has an anti-rotation guidance component for anti-rotation guidance of the switch element relative to a surrounding structure, and a hydraulic clearance equalization element having a pressure system is installed in the inner element, and wherein the anti-rotation safety element is separately located from the pistons and the annular groove, and maintains the offset between the at least one oil port and the pistons by substantially preventing the inner element and the outer part from rotating with respect to each other, such that hydraulic fluid inserted through the at least one oil port can propagate along the annular groove towards the pistons for displacing the pistons away from the annular groove.

2. A switch element according to claim 1, wherein the anti-rotation safety element is arranged as a radially projecting element, fixed in one of the outer part and inner element and guided in a lengthwise recess of another one of the outer part and inner element.

3. A switch element according to claim 1, wherein the anti-rotation guidance component includes one or more flattenings on an outer surface of the outer part.

4. A switch element according to claim 1, wherein a roller is arranged on the outer part as cam follower.

5. A switch element for a valve drive of an internal combustion engine, the switch element comprising:

an outer part having a bore therein and an annular groove facing the bore;

an inner element axially movable in the bore, the inner element having a radial bore and being adapted to receive a hydraulic clearance equalization element having a pressure system;

an anti-rotation safety element arranged to substantially prevent the inner element from rotating with respect to the outer part;

a lost-motion spring biasing one of the outer part and inner element with respect to another one of the outer part and inner element; and diametrically opposed pistons in the radial bore, to be displaced at least partially into the annular groove to couple the inner element to the outer part, the pistons each having a lower surface to contact an inner surface of the outer part adjacent the annular groove, wherein the outer part has at least one oil port offset in a circumferential direction from the pistons, and the anti-rotation safety element is separately located from the pistons and the annular groove, and maintains the offset between the at least one oil port and the pistons by substantially preventing the inner element from rotating with respect to the outer part, such that hydraulic fluid inserted through the at least one oil port can propagate along the annular groove towards the pistons for displacing the pistons away from the annular groove.

6. A switch element according to claim 5, wherein the anti-rotation safety element is fixed to one of the outer part and inner element.

7. A switch element according to claim 6, wherein the anti-rotation safety element projects in a recess of another one of the outer part and inner element.

8. A switch element according to claim 5, wherein the outer part also has at least one anti-rotation component providing anti-rotation guidance of the switch element relative to a surrounding structure.

9. A switch element according to claim 8, wherein the at least one anti-rotation component is formed by one or more substantially flat outer surfaces of the outer part.

10. A switch element according to claim 5, further comprising a roller adjacent to the outer part as a cam follower.

11. A switch element according to claim 5, wherein the at least one oil port is offset in a circumferential direction from the pistons by substantially 90°.

12. A switch element according to claim 5, wherein the lower surface of each piston is substantially planar.

13. A switch element according to claim 12, wherein each piston has an end, at least part of which is curved in shape.

14. A switch element according to claim 5, wherein a further port is formed in a lower portion of the inner element, and is in communication with the radial bore.

15. A switch element according to claim 5, wherein the inner element includes a lower end defining a raised pad.

16. A switch element according to claim 5, wherein the lost-motion spring comprises at least two springs.

17. A switch element according to claim 5, wherein the outer part also has a further annular groove facing the bore and disposed below the inner element at least when the pistons couple the inner element to the outer part.

18. A switch element according to claim 5, wherein part of an outer surface of the outer part, disposed proximate to a lower end of the outer part, forms an annular recess.

19. A switch element according to claim 5, wherein a lower surface of the outer part has a further bore formed therethrough, and the further bore is in communication with the bore of the outer part.

20. A switch element according to claim 5, wherein the outer part includes a lower end having a U-shaped configuration for engaging a roller adapted to engage a cam.

21. A switch element according to claim 5, wherein a recess is formed in a lower surface of the outer part facing the bore, and the recess forms a seat for receiving a lower part of the lost-motion spring.

22. A switch element according to claim 5, wherein each of the pistons has a stepped flat for engagement with the inner surface of the outer part adjacent the annular groove.

23. A switch element according to claim 5, wherein the at least one oil port includes at least two diametrically opposed oil ports offset in a circumferential direction from the pistons.

24. A switch element according to claim 5, further comprising an anti-rotation component arranged to substantially prevent rotation of the pistons.

25. A switch element according to claim 5, further comprising a spring biasing the pistons away from each other.

26. A switch element according to claim 5, further comprising a stop member arranged to limit displacement of the pistons towards each other.

* * * * *